US005785063A

United States Patent [19]

DePinto

[11] Patent Number: 5,785,063

[45] Date of Patent: Jul. 28, 1998

[54] COMBINATION TOOTHBRUSH AND DRINKING CUP

[76] Inventor: John DePinto, 77 Merryall Rd., New Mifford, Conn. 06776

[21] Appl. No.: 794,182

[22] Filed: Feb. 3, 1997

[51] Int. Cl.[6] ..... A46B 11/00; A46B 15/00

[52] U.S. Cl. ..... 132/200; 132/308; 132/310; 132/290; 132/311; 206/361; 206/764; 401/124

[58] Field of Search ..... 132/308, 310, 132/311, 286, 290, 200; 15/167.1, 143.1, 145, 167.2; 206/361, 362, 764; 401/123, 124, 125, 131; D6/531, 527, 528; D4/104, 108, 113, 199

[56] References Cited

U.S. PATENT DOCUMENTS

| | | | |
|---|---|---|---|
| D. 357,151 | 4/1995 | Santapa | D6/531 |
| 1,242,821 | 10/1917 | Lewis | 132/311 |
| 4,234,087 | 11/1980 | Pandak | 206/361 |
| 4,717,278 | 1/1988 | Kameny | 132/308 |
| 5,348,028 | 9/1994 | Gustavel | 132/308 |
| 5,636,933 | 6/1997 | Vizsolyi | 132/308 |
| 5,638,840 | 6/1997 | Lee et al. | 132/310 |

FOREIGN PATENT DOCUMENTS

| | | | |
|---|---|---|---|
| 929840 | 1/1948 | France | 401/124 |

*Primary Examiner*—Gene Mancene
*Assistant Examiner*—Pedro Philogene
*Attorney, Agent, or Firm*—Michael I. Kroll

[57] ABSTRACT

A combination toothbrush and drinking cup (10) comprising a toothbrush segment (12). An enlarged hollow handle segment (14) is also provided. A facility (16) is for attaching the toothbrush segment (12) to the enlarged hollow handle segment (14) for better gripping by a hand (18) when brushing teeth (20). When inverted the enlarged hollow handle segment (14) can become a water receiving receptacle to drink from.

1 Claim, 4 Drawing Sheets

Fig. 3
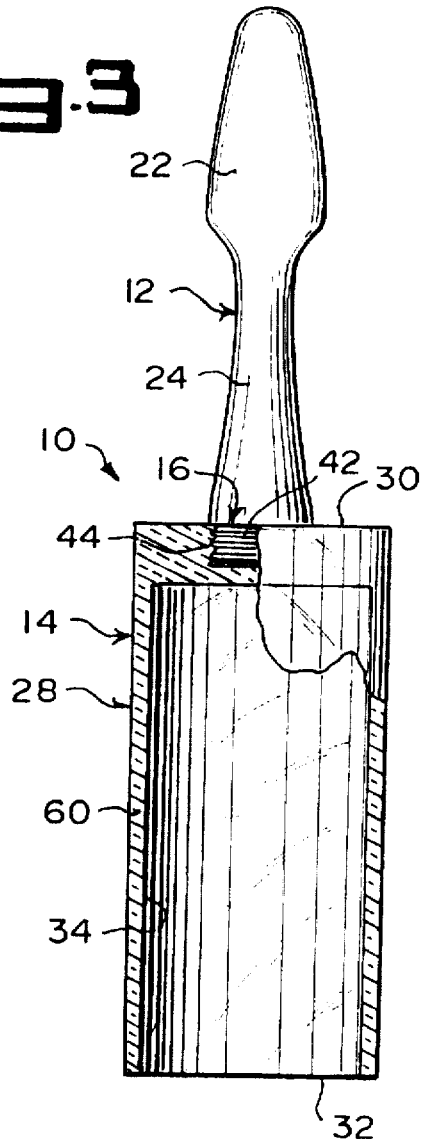
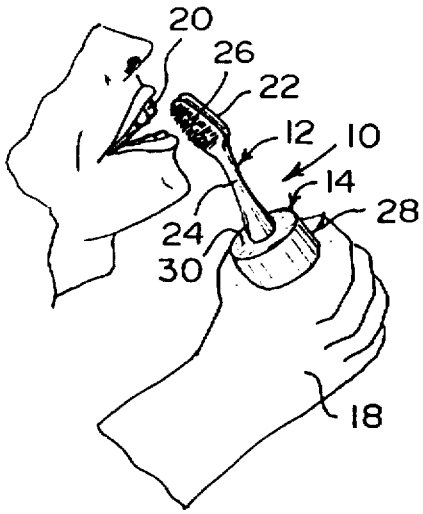
Fig. 4

COMBINATION TOOTHBRUSH AND DRINKING CUP

BACKGROUND OF THE INVENTION

1. Field of the Invention

The instant invention relates generally to dental equipment and more specifically it relates to a combination toothbrush and drinking cup. The combination toothbrush and drinking cup contains an enlarged hollow handle which when inverted becomes a water receptacle to drink from.

2. Description of the Prior Art

Numerous dental equipment have been provided in prior art. For example, U.S. Pat. No. 4,033,007 to Hadary; U.S. Pat. No. 4,527,574 to Manfredi; U.S. Pat. No. 4,887,621 to Vallieres and U.S. Pat. No. 5,044,386 to Nelson all are illustrative of such prior art. While these units may be suitable for the particular purpose to which they address, they would not be as suitable for the purposes of the present invention as heretofore described.

HADARY, JOSEPH

Toothbrush

U.S. Pat. No. 4,033,007

A toothbrush having a bristle supporting head pivotally mounted to a handle for pivotal movement of the head and bristles about a pivot axis substantially perpendicular to the axis of the handle to a plurality of positions to gain easy access to tooth surfaces at opposite sides of the mouth. The bristles extend in a direction mutually perpendicular to the axis of the handle and pivot axis. The handle has an enlarged hollow end for storage therein of a bristle supporting head or the like and for supporting the toothbrush in an upright, free standing position.

MANFREDI, JOHN A.

Portable Dental Kit

U.S. Pat. No. 4,527,574

A portable dental kit has a handle having two ends. A toothbrush is attached at one end of the handle. The other end of the handle is open. The handle defines a hollow interior. A removable cover means is for the toothbrush. A toothpaste container is shaped and adapted to be inserted into the hollow handle, through the open end. The container has a flexible side wall, and a dispensing opening and closure cap at one end. At the other end, there is a filling member inserted into the side wall. A filling bore is on the interior of the member. A closure cap is removably attachable to the member. The side wall of the container is of a reduced diameter with respect to the diameter of the interior of the hollow handle. There is an enlarged diameter portion at the other end of the container. A clamping collar encircles the flexible side wall around a portion of the filling member and fastens the two together.

VALLIERES, LOUIS

Combination Toothbrush and Dental Floss Holder

U.S. Pat. No. 4,887,621

A hollow handled toothbrush that includes a detachable toothbrush and includes a cavity for receiving a spool of dental floss. A support platform is releasably attached for loading and unloading spools of dental floss into the cavity on spool guides. The platform includes a dental floss opening and supports a cutter for cutting the dental floss. A removable screw cap covers and protects the cutting blade and dental floss.

NELSON, GARY M.

Portable Dental Care Unit

U.S. Pat. No. 5,044,386

A portable dental care unit is disclosed, including an upper piece and a lower piece. The upper piece has a head portion and bristles which are attached to and extend generally laterally from the head portion. A base of the upper piece is selectively attached to the lower piece such that the lower piece forms a handle for the toothbrush apparatus. An intermediate portion interconnects the head portion and the base portion and includes a recessed region formed below the bristles. The lower piece has a receptacle for accommodating a first dentifrice therein. A container is received by the recessed region for holding a second dentifrice therein. A closure is selectively engaged with the toothbrush apparatus for provisionally enclosing at least the head portion and the bristles of the upper piece between uses.

SUMMARY OF THE INVENTION

A primary object of the present invention is to provide a combination toothbrush and drinking cup that will overcome the shortcomings of the prior art devices.

Another object is to provide a combination toothbrush and drinking cup, in which an enlarged hollow handle for better gripping by a hand when inverted can become a water receiving receptacle to drink from, so that a person does not have to put their mouth or hand under a faucet to drink the water therefrom.

An additional object is to provide a combination toothbrush and drinking cup with a stand to hold the enlarged hollow handle in an upright free standing position.

A further object is to provide a combination toothbrush and drinking cup that is simple and easy to use.

A still further object is to provide a combination toothbrush and drinking cup that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a rear elevational view taken in the direction of arrow 3 in FIG. 1, showing the instant invention removed from the stand with parts broken away and in section.

FIG. 4 is a top perspective view, showing the instant invention being used to clean teeth.

Similar reference characters denote corresponding features consistently throughout the attached drawings.

DETAILED DESCRIPTION OF THE PREFERRED EMBODIMENTS

Figure 1:
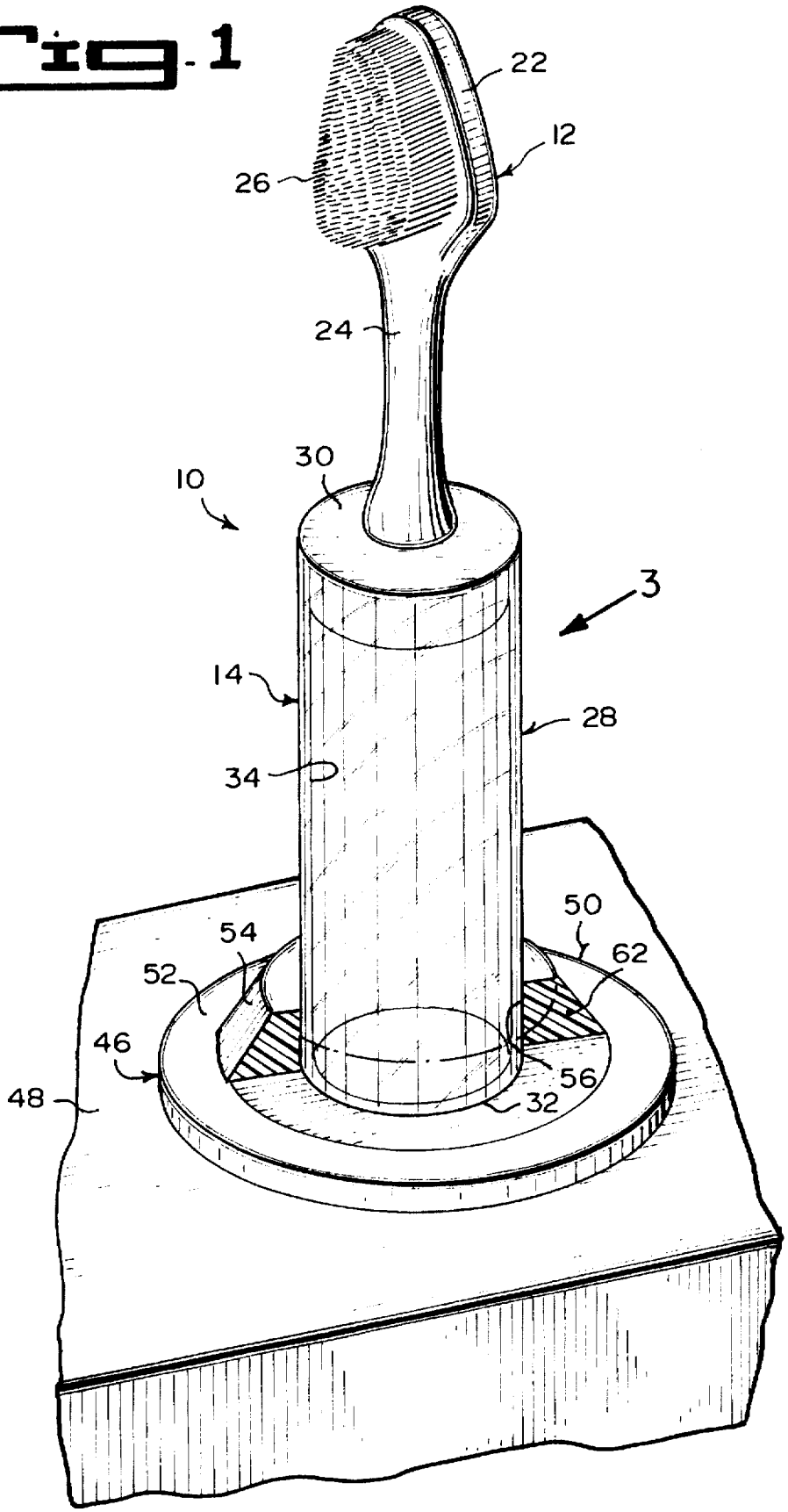
FIG. 1 is a top perspective view of the instant invention supported upright in a stand that is broken away and in section.
Figure 2:
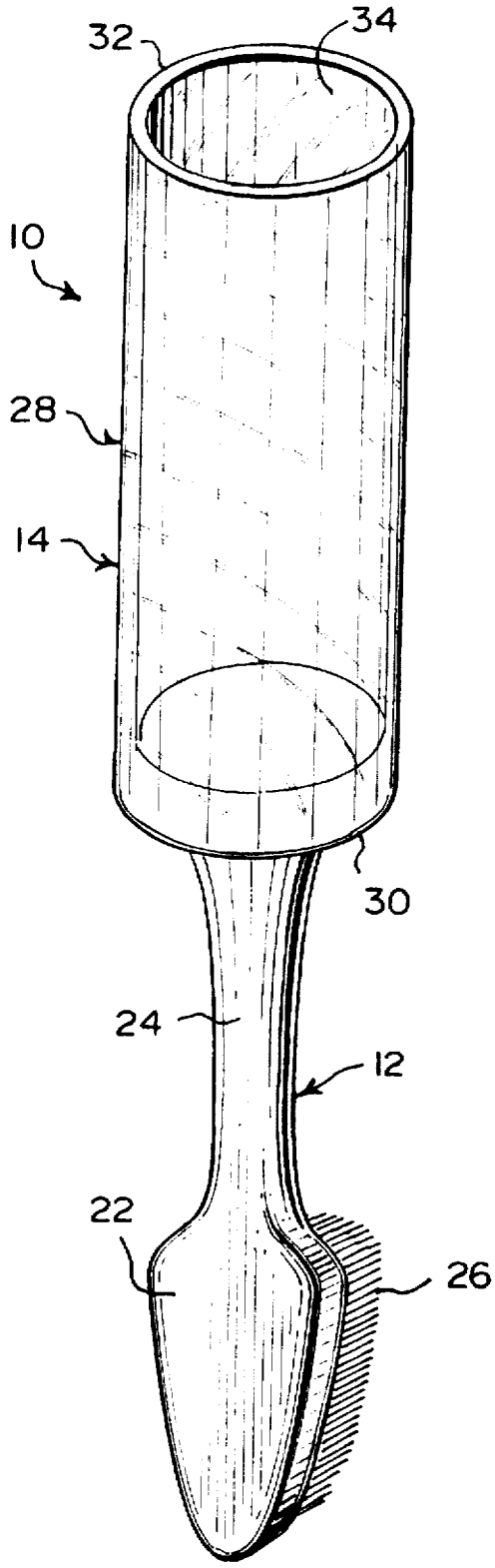
FIG. 2 is an inverted bottom perspective view of the instant invention removed from the stand.
Figure 5:
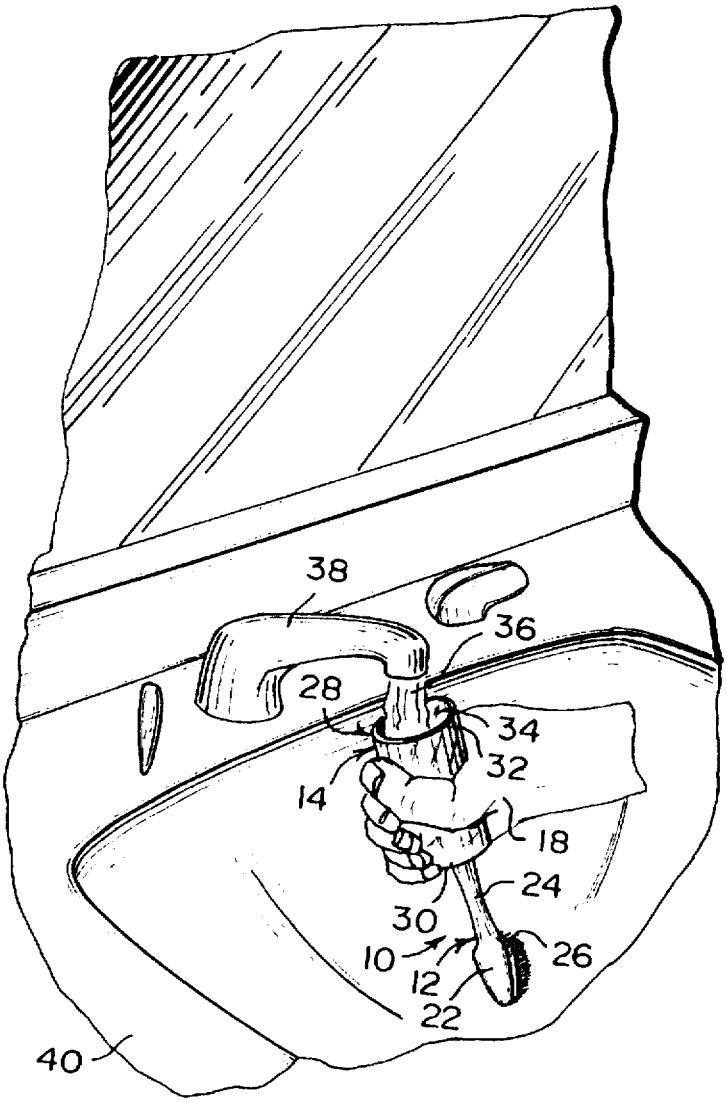
FIG. 5 is an inverted bottom perspective view, showing the instant invention being filled with water form a faucet in a sink to drink.

Turning now descriptively to the drawings, in which similar reference characters denote similar elements throughout the several views, FIGS. 1 through 6 illustrate a combination toothbrush and drinking cup 10 comprising a toothbrush segment 12. An enlarged hollow handle segment 14 is also provided. A facility 16 is for attaching the toothbrush segment 12 to the enlarged hollow handle segment 14, for better gripping by a hand 18 when brushing teeth 20. When inverted, the enlarged hollow handle segment 14 can become a water receiving receptacle to drink from.

The toothbrush segment 12 includes a head 22. A stem 24 is integral with and extends longitudinally away from the head 22. A plurality of bristles 26 extend laterally from the head 22.

The enlarged hollow handle segment 14 consists of a cylindrical member 28 having a closed end 30 and an open end 32 with a chamber 34 therein. When the cylindrical member 28 is inverted with the closed end 30 positioned down and the open end 32 positioned up, water 36 can flow into the chamber 34 from a faucet 38 in a sink 40, to allow a person to drink the water 36 from the cylindrical member 28 (see FIG. 5).

As shown in FIG. 3, the attaching facility 16 comprises an externally threaded shank 42 extending from a bottom end of the toothbrush segment 12. The closed end 30 of the enlarged hollow handle segment 14 has an internally threaded hole 44. The externally threaded shank 42 can screw into the internally threaded hole 44 and be retained thereto.

Figure 6:
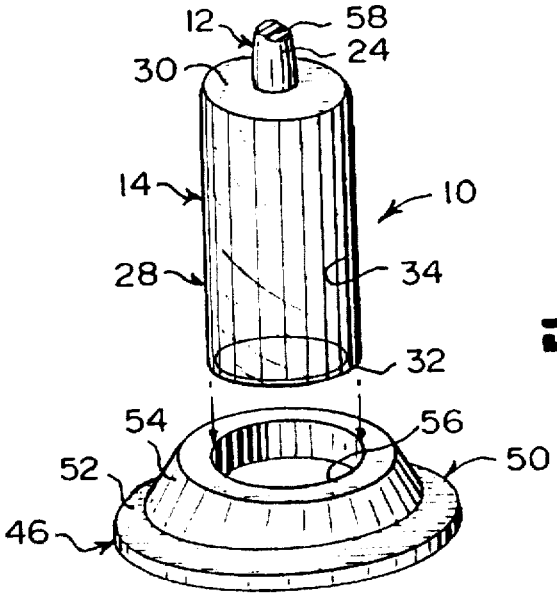
FIG. 6 is a top perspective view of the instant invention with parts broken away and in section, ready to be inserted into the stand.

A component 46, as shown in FIGS. 1 and 6, is for supporting the cylindrical member 28 in an upright free standing position upon a horizontal flat surface 48. The supporting component 46 is a stand 50. The stand 50 includes an annular base flange 52, to sit upon the horizontal flat surface 48. A frustum cone portion 54 extends upwardly from the annular base flange 52. The frustum cone portion 54 has a vertical aperture 56 therethrough, to receive the open end 32 of the cylindrical member 28 therein.

The head 22 and the stem 24 of the toothbrush segment 12 are fabricated out of a strong durable plastic material 58. The cylindrical member 28 is fabricated out of a strong durable transparent plastic material 60. The stand 50 is fabricated out of a strong heavyweight durable plastic material 62.

OPERATION OF THE INVENTION

To use the combination toothbrush and drinking cup 10, the following steps should be taken:

1. Grasp the stem 24 of the toothbrush segment 12 by a hand 18, so that the externally threaded shank 42 extends downwardly.
2. Hold the cylindrical member 28 of the enlarged hollow handle segment 14 by another hand 18, so that the closed end 30 with the internally threaded hole 40 extends upwardly.
3. Screw the externally threaded shank 42 into the internally threaded hole 40, as shown in FIG. 3.
4. Grip the cylindrical member 28 by the hand 18 and brush the teeth 20 with the bristles 26 of the toothbrush segment 12, as shown in FIG. 4.
5. Invert the cylindrical member 28 in the hand 18, so that the open end 32 extends upwardly.
6. Place the open end 32 of the cylindrical member 28 under the faucet 38 of the sink 40.
7. Turn the faucet 38 on, so that the water 36 will flow into the chamber 34, as shown in FIG. 4.
8. Drink the water 36 from the open end 32 of the cylindrical member 28.
9. Put the stand 50 upon the horizontal flat surface 48.
10. Insert the open end 32 of the cylindrical member 28 into the vertical aperture 56 in the frustum cone portion 54 of the stand 50 when not being used, as shown in FIG. 1.
11. Remove the open end 32 of the cylindrical member 28 from the vertical aperture 56 in the frustum cone portion 54 of the stand 50.
12. Unscrew the externally threaded shank 42 of the toothbrush segment 12 from the internally threaded hole 40.
13. Invert the cylindrical member 28 again, so that the open end 32 extends upwardly.
14. Place the toothbrush segment 12 through the open end 32 and into the chamber 34 of the cylindrical member 28 for storage or travel, when the need arises.

| LIST OF REFERENCE NUMBERS | |
|---|---|
| 10 | combination toothbrush and drinking cup |
| 12 | toothbrush segment of 10 |
| 14 | enlarged hollow handle segment of 10 |
| 16 | attaching facility of 10 |
| 18 | hand |
| 20 | teeth |
| 22 | head of 12 |
| 24 | stem of 12 |
| 26 | bristle of 12 |
| 28 | cylindrical member for 14 |
| 30 | closed end of 28 |
| 32 | open end of 28 |
| 34 | chamber in 28 |
| 36 | water from 38 |
| 38 | faucet of 40 |
| 40 | sink |
| 42 | externally threaded shank of 16 |
| 44 | internally threaded hole of 16 in 30 |
| 46 | supporting component of 10 |
| 48 | horizontal flat surface |
| 50 | stand for 46 |
| 52 | annular base flange of 50 |
| 54 | frustum cone portion of 50 |
| 56 | vertical aperture in 54 |
| 58 | strong durable plastic material for 22 and 24 |
| 60 | strong durable transparent plastic material for 28 |
| 62 | strong heavyweight durable plastic material for 50 |

It will be understood that each of the elements described above, or two or more together may also find a useful application in other types of methods differing from the type described above.

While certain novel features of this invention have been shown and described are pointed out in the annexed claims.

it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of brushing teeth comprising the steps of:

a) grasping a combination toothbrush and drinking cup which comprises a toothbrush having a head with bristles and a stem integral with and extending longitudinally away from said head, means forming a drinking cup comprising an enlarged hollow handle for said tooth brush, and means for attaching said stem to said enlarged hollow handle segment with the mouth of said drinking cup facing away from said head;

b) holding said stem with said tooth brush uprignt and the mouth of said drinking cup facing down;

c) brushing teeth with said tooth brush;

d) inverting said cylindrical member so that said drinking cup is upright for drinking;

e) filling said drinking cup with water;

f) drinking the water from said drinking cup; and placing said combination tooth brush and drinking cup with the tooth brush upright on a stand comprising an annular base flange to sit upon a horizontal flat surface and a frustum cone portion extending upwardly from said annular base flange, said frustum cone portion having a vertical aperture for receiving the open mouth of said drinking cup.

* * * * *